US009995468B2

(12) United States Patent
Liang

(10) Patent No.: US 9,995,468 B2
(45) Date of Patent: Jun. 12, 2018

(54) ILLUMINATION DEVICE

(71) Applicant: Nextorch Industries Co., Ltd., Guangdong (CN)

(72) Inventor: Bing Liang, Guangdong (CN)

(73) Assignee: NEXTORCH INDUSTRIES, LTD., Guangdong (CN)

( * ) Notice: Subject to any disclaimer, the term of this patent is extended or adjusted under 35 U.S.C. 154(b) by 81 days.

(21) Appl. No.: 15/156,727

(22) Filed: May 17, 2016

(65) Prior Publication Data

US 2016/0348881 A1 Dec. 1, 2016

(30) Foreign Application Priority Data

May 27, 2015 (CN) ..... 2015 2 0353575 U

(51) Int. Cl.

| | |
|---|---|
| ***F21V 1/00*** | (2006.01) |
| ***F21V 11/00*** | (2015.01) |
| ***F21V 19/04*** | (2006.01) |
| *F21V 7/06* | (2006.01) |
| *F21V 5/04* | (2006.01) |
| *F21V 7/00* | (2006.01) |
| *F21V 23/04* | (2006.01) |
| *F21Y 115/10* | (2016.01) |

(52) U.S. Cl.

CPC ..... *F21V 19/04* (2013.01); *F21V 5/04* (2013.01); *F21V 7/0066* (2013.01); *F21V 7/06* (2013.01); *F21V 23/04* (2013.01); *F21Y 2115/10* (2016.08)

(58) Field of Classification Search

CPC . F21V 19/04; F21V 23/04; F21V 5/04; F21V 7/0066; F21V 7/06; F21Y 2115/10

USPC ..... 362/35, 84, 235

See application file for complete search history.

(56) References Cited

U.S. PATENT DOCUMENTS

| | | | | |
|---|---|---|---|---|
| 5,041,947 | A * | 8/1991 | Yuen | F21S 10/06 345/31 |
| 6,953,274 | B2 * | 10/2005 | Rice | B60Q 1/12 362/271 |
| 8,523,924 | B2 * | 9/2013 | Meyer | C09K 11/06 607/88 |
| 9,470,382 | B1 * | 10/2016 | Sharrah | F21L 4/02 |
| 9,732,942 | B2 * | 8/2017 | Jorgensen | F21V 14/00 |
| 2006/0133104 | A1 * | 6/2006 | Okubo | B60Q 1/12 362/545 |
| 2009/0268458 | A1 * | 10/2009 | Feinbloom | F21V 14/06 362/240 |
| 2010/0290220 | A1 * | 11/2010 | McDermott | F21S 10/02 362/231 |
| 2011/0164422 | A1 * | 7/2011 | Chan | F21V 14/04 362/284 |

(Continued)

*Primary Examiner* — Tsion Tumebo

(74) *Attorney, Agent, or Firm* — Porter Wright Morris & Arthur LLP

(57) ABSTRACT

The invention provides an illumination device, which includes: a support block; multiple light source emitting parts, provided on the support block; one light guiding part, used for guiding light emitted by the light source emitting parts to a preset irradiation direction; and a light source switching mechanism, the light guiding part being selectively matched with one of the multiple light source emitting parts under the action of the light source switching mechanism. According to the illumination device of the invention, the illumination device is smaller in size and convenient to carry.

17 Claims, 4 Drawing Sheets

(56) References Cited

U.S. PATENT DOCUMENTS

2012/0140442 A1* 6/2012 Woo ..... F21V 7/04
362/95
2014/0185285 A1* 7/2014 Jorgensen ..... F21V 14/02
362/232

* cited by examiner

ILLUMINATION DEVICE

TECHNICAL FIELD OF THE INVENTION

The invention relates to the field of illumination, and in particular to an illumination device.

BACKGROUND OF THE INVENTION

In a conventional art, an illumination device consists of one light source emitting part and one light guiding part or consists of multiple light source emitting parts and multiple light guiding parts corresponding to the multiple light source emitting parts one to one, and the light guiding parts are reflector cups.

The illumination device in the conventional art has shortcomings as follows: the illumination device with one light source emitting part may not meet some special market requirements, such as a requirement of hunting on a combination of green light and white light; and although the illumination device with multiple light source emitting parts and multiple reflector cups may meet a requirement on multiple light sources, but such a product is usually larger in size and inconvenient to carry because multiple reflector cups are required.

SUMMARY OF THE INVENTION

A main purpose of the invention is to provide an illumination device, so as to solve the problems of large size and difficulty in carrying of an illumination device in the conventional art.

In order to achieve the purpose, the invention provides an illumination device, which comprises: a support block; multiple light source emitting parts, provided on the support block; one light guiding part, used for guiding light emitted by the light source emitting parts to a preset irradiation direction; and a light source switching mechanism, the light guiding part being selectively matched with one of the multiple light source emitting parts under the action of the light source switching mechanism.

Furthermore, the illumination device further comprises a substrate, the support block is located in the substrate, and the light source switching mechanism comprises: a driving part, provided on a periphery of the substrate in a sleeving manner and capable of rotating relative to the substrate; and a transmission structure, provided in the driving part to convert rotation of the driving part into linear movement of the support block relative to the substrate.

Furthermore, the driving part is provided with a driving surface, and a distance between the driving surface and a rotating centre of the driving part is variable.

Furthermore, the transmission structure is an ejector rod, the substrate is provided with a first through hole matched with the ejector rod, a first end of the ejector rod is connected with the support block after penetrating through the first through hole, and a second end of the ejector rod is provided slidably along the driving surface.

Furthermore, the transmission structure comprises two magnets which are provided at an interval, and a distance between the two magnets changes along with rotation of the driving part.

Furthermore, one of the two magnets is connected with the support block, and the other of the two magnets is provided on the substrate, and is provided slidably along the driving surface of the driving part.

Furthermore, the illumination device further comprises a resetting element provided in the substrate, and the resetting element and the transmission structure are correspondingly provided at two ends, which are provided with interval, of the support block respectively.

Furthermore, the resetting element is a spring, one end of the spring is connected with the support block, and the other end of the spring is connected with the substrate.

Furthermore, the multiple light source emitting parts are linearly provided or provided with intervals along a circumferential direction of the support block.

Furthermore, the light guiding part is a lens or a reflector cup with a paraboloid.

Furthermore, the illumination device further comprises a controller for controlling turning-on and turning-off of the light source emitting parts.

Furthermore, the controller is a thimble switch or a Hall switch.

According to the technical solution of the invention, the illumination device comprises the light guiding part, the multiple light source emitting parts and the light source switching mechanism, and the light guiding part may be driven by the light source switching mechanism to be selectively matched with one of the multiple light source emitting parts according to a requirement; and since the light guiding part is shared by the multiple light source emitting parts, the illumination device is smaller in size and convenient to carry.

BRIEF DESCRIPTION OF THE DRAWINGS

Specification drawings forming a part of the invention are adopted to provide further understanding of the invention, and schematic embodiments of the invention and description thereof are adopted to explain the invention and not intended to form improper limits to the invention. In the drawings.

Wherein, the drawings include the following drawing reference signs:

1: support block; 2: light source emitting part; 3: light guiding part; 4: light source switching mechanism; 41: driving part; 42: transmission structure; 421: ejector rod; 422: magnet; 423: magnet substrate; 5: substrate; 6: resetting element; 61: spring; and 7: controller.

DETAILED DESCRIPTION OF THE EMBODIMENTS

It is important to note that embodiments in the invention and characteristics in the embodiments can be combined under the condition of no conflicts. The invention will be described below with reference to the drawings and the embodiments in detail.

In the invention and the embodiments of the invention, one direction refers to a horizontal direction of an illumination device, and another direction refers to a longitudinal direction of the illumination device.

First Embodiment

Figure 1:
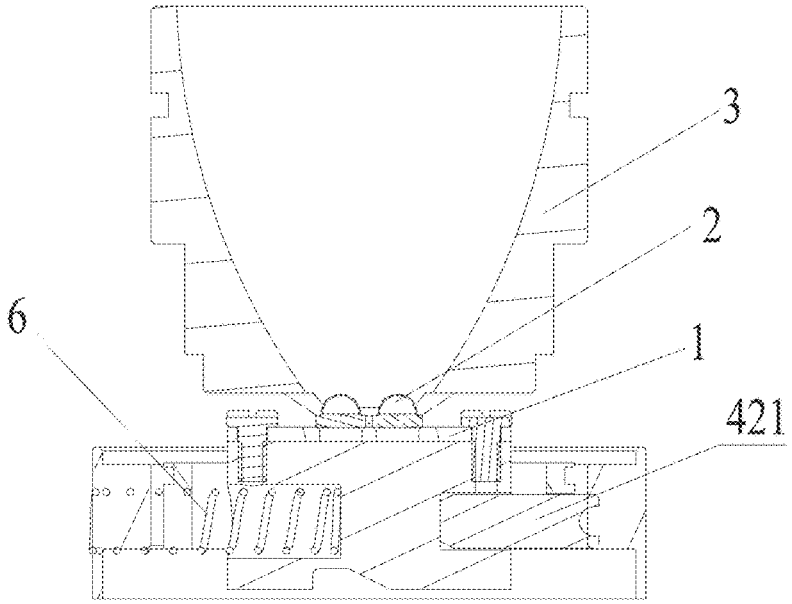
FIG. 1 is a section view of a first embodiment of an illumination device according to the invention.
Figure 2:
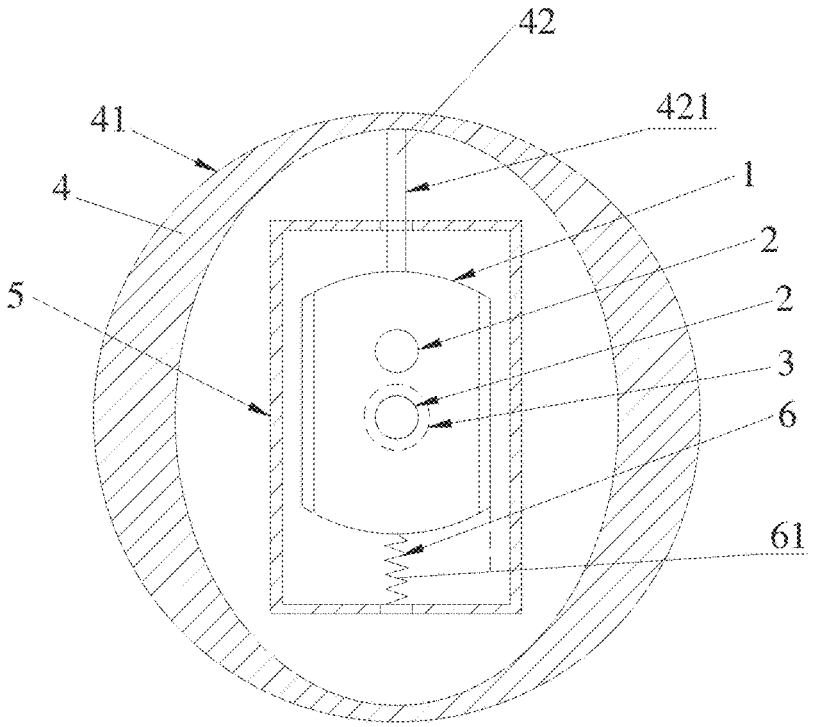
FIG. 2 is a local section view of a first embodiment of an illumination device in one direction according to the invention.
Figure 3:
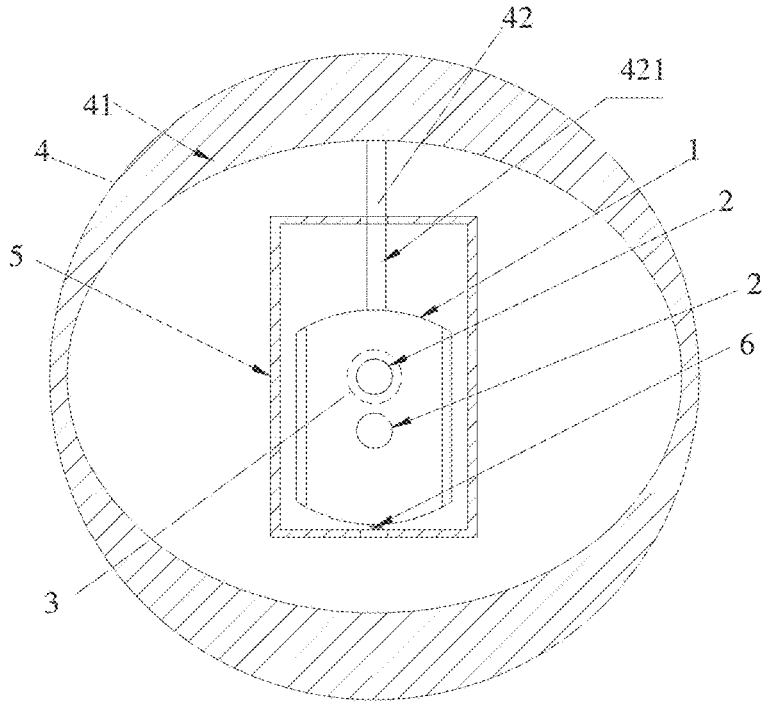
FIG. 3 is a section view of a driving part in FIG. 2 at a second position.
Figure 4:
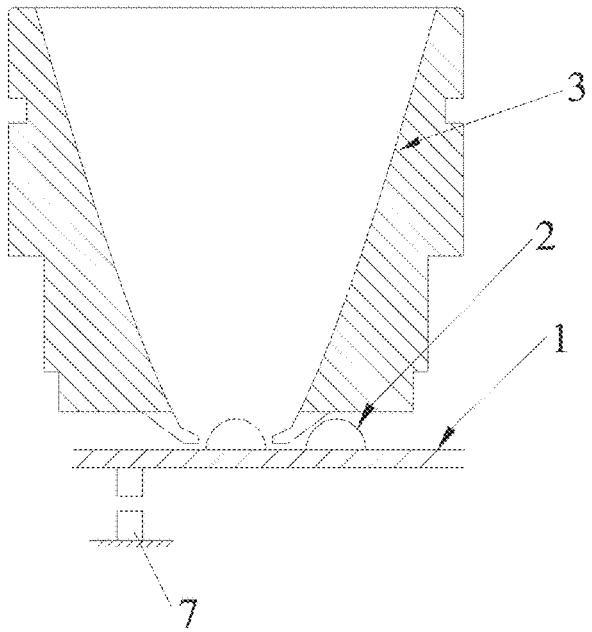
FIG. 4 is a section view (a part of structures are not shown) of a first embodiment of an illumination in another direction according to the invention.

FIG. 1 and FIG. 4 are longitudinal section views of an illumination device according to a first embodiment of the invention respectively, and FIG. 2 and FIG. 3 are horizontal section views of an illumination device according to the first embodiment of the invention respectively. As shown in FIG. 1 to FIG. 4, in the first embodiment of the invention, the illumination device comprises a support block 1, two light source emitting parts 2 linearly provided on the support block 1, one light guiding part 3 and a light source switching mechanism 4. The light guiding part 3 is used for guiding light emitted by the light source emitting parts 2 to a preset irradiation direction; and the light guiding part 3 is selectively matched with one of the two light source emitting parts 2 under the action of the light source switching mechanism 4.

By such arrangement, the light guiding part 3 may be selectively matched with one of the two light source emitting parts 2 according to a practical requirement under the action of the light source switching mechanism 4, and the illumination device is compact in structure and convenient to carry.

As shown in FIG. 2, in the first embodiment of the invention, the illumination device further comprises a substrate 5, the support block 1 is located in the substrate 5, and the light source switching mechanism 4 comprises a driving part 41 and a transmission structure 42. The driving part 41 is provided on a periphery of the substrate 5 in a sleeving manner, and may rotate relative to the substrate 5; and the transmission structure 42 is provided in the driving part 41 to convert rotation of the driving part 41 into linear movement of the support block 1 relative to the substrate 5.

Wherein, the driving part 41 is provided with a driving surface, and a distance between the driving surface and a rotating centre of the driving part 41 is variable. Specifically, the driving part 41 is a driving rotating ring, an inner wall surface of the driving rotating ring forms the driving surface, and a cross section of the inner wall surface of the driving rotating ring is shaped into an ellipse.

As shown in FIG. 4, in the first embodiment, the light source emitting parts 2 are Light-Emitting Diode (LED) lamps, and the light guiding part 3 is a reflector cup with a paraboloid. The reflector cup may be utilized to guide the light emitted by the LED lamps to the preset irradiation direction.

Of course, in an alternative embodiment not shown in the invention, the light source emitting parts 2 may also be provided to be other luminous parts capable of implementing illumination, such as lamp strips.

As shown in FIG. 2, the transmission structure 42 is an ejector rod 421, the substrate 5 is provided with a first through hole matched with the ejector rod 421, a first end of the ejector rod 421 is connected with the support block 1 after penetrating through the first through hole, and a second end of the ejector rod 421 is provided slidably along the inner wall surface of the driving rotating ring.

As shown in FIG. 2, in order to facilitate returning of the support block 1 to an initial position, the illumination device further comprises a resetting element 6 provided in the substrate 1, and the resetting element 6 and the transmission structure 42 are correspondingly provided at two ends, which are provided with interval, of the support block 1 respectively.

In the first embodiment, the resetting element 6 is specifically provided to be a spring 61, one end of the spring 61 is connected with the support block 1, and the other end of the spring 61 is connected with the substrate 5.

As shown in FIG. 4, in the first embodiment of the invention, the illumination device further comprises a controller 7 used for controlling turning-on and turning-off of the light source emitting parts 2. In the first embodiment, the controller 7 controls the turning-on and turning-off of the light source emitting parts 2 in a sensing control manner.

Specifically, the controller comprises a signal emitting source and two sensing elements corresponding to the two LED lamps respectively, such as Hall switches. The sensing elements (Hall switches) at least have first positions close to the signal emitting source and second positions far away from the signal emitting source, the LED lamps are controlled to be turned on and off when the Hall switches correspond to (namely get close to or far away from the signal emitting source) the signal emitting source, the LED lamps are controlled to be turned on when the Hall switches get close to the signal emitting source, and the LED lamps are controlled to be turned off when the Hall switches get far away from the signal emitting source.

On the contrary, in an alternative implementation mode of the invention, the LED lamps are turned off when the Hall switches get close to the signal emitting source, and the LED lamps are turned on when the Hall switches get far away from the signal emitting source.

Since the sensing elements, such as the Hall switches, have characteristics of no electric shock, low power consumption, long service life, high response frequency and the like, the illumination device is high in response frequency and convenient to use.

A specific implementation process of a first implementation mode will be described below for FIGS. 2 and 3.

As shown in FIG. 2, when the ejector rod 421 is located at a large-diameter end of the driving rotating ring (i.e. a long-axis end of an elliptical inner hole of the driving rotating ring), the reflector cup serving as the light guiding part 3 is fixed, the spring 61 is in a reset state, the support block 1 is also at the initial position shown in FIG. 2, one LED lamp is located in a working area of the reflector cup, the other LED lamp is located outside the working area of the reflector cup, and meanwhile, the Hall switches control the LED lamp located in the working area of the reflector cup to be turned on, and control the LED lamp located outside the working area of the reflector cup to be turned off; and the driving rotating ring may enter a state shown in FIG. 3 after clockwise or counter clockwise rotating 90 degrees around the substrate 5, the reflector cup serving as the light guiding part 3 is fixed in a rotating process, as shown in FIG. 3, the ejector rod 421 is located at a small-diameter end of the driving rotating ring (i.e. a short-axis end of the elliptical inner hole of the driving rotating ring), the spring 61 is in a compressed state, the support block 1 is driven by the ejector rod 421 to move downwards, then a lower LED lamp leaves the working area of the reflector cup, an upper LED lamp is located in the working area of the reflector cup, and the Hall switches control the upper LED lamp to work and control the lower LED lamp to be turned off.

Second Embodiment

Figure 5:
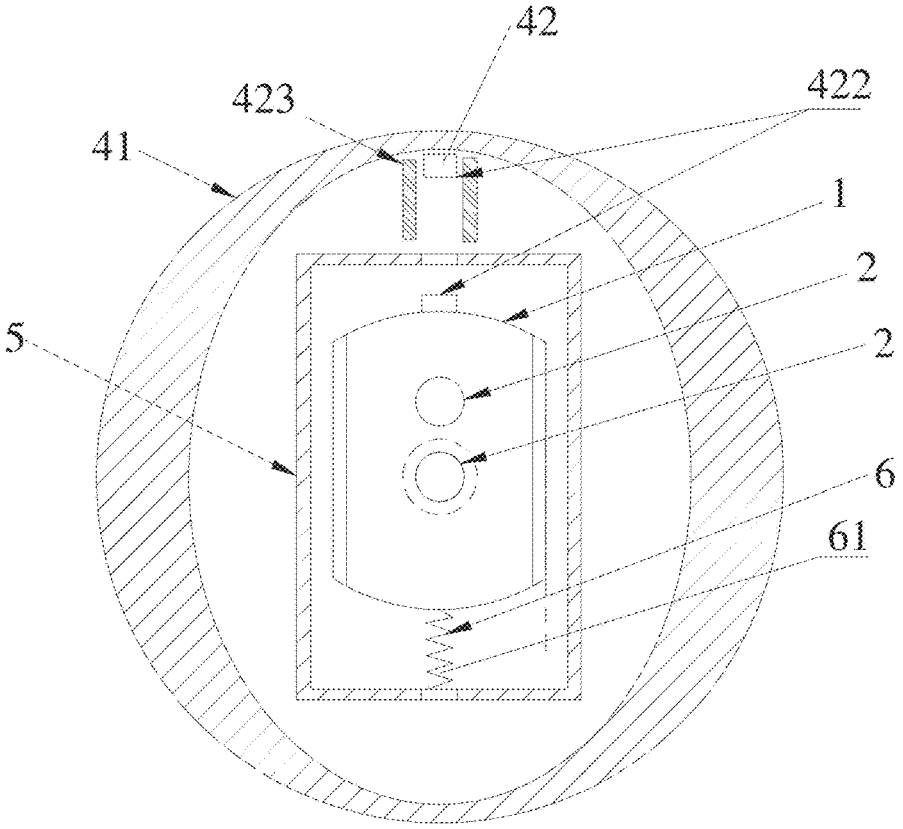
FIG. 5 is a section view of a second embodiment of an illumination device in one direction according to the invention.

FIG. 5 is a second embodiment of an illumination device according to the invention, and a difference from the first embodiment is that: in the second embodiment, the transmission structure 42 comprises two magnets 422 which are provided at an interval, and a distance between the two magnets 422 changes along with rotation of the driving part 41.

The distance between the two magnets 422 is changed, thereby changing magnitude of magnetic force between the two magnets to further fulfil the aim of driving the support block 1 to move downwards along a vertical direction.

Specifically, as shown in FIG. 5, the light source switching mechanism 4 comprises a magnet substrate 423 fixed relative to the substrate 5. One of the two magnets 422 is connected with the support block 1, and the other of the two magnets 422 is provided on the substrate 5, and may linearly move along the magnet substrate 423.

As shown in FIG. 5, two surfaces, close to each other, of the magnets 422 are homopolar surfaces, that is, the two magnets repel each other. When the magnets 422 are located at the large-diameter end of the elliptical driving rotating ring (i.e. the long-axis end of the elliptical inner hole), the distance between the two magnets is longer, repulsive force between the magnets is smaller, the spring 61 is in the reset state, and the lower LED lamp is located in the working area of the reflector cup. When it is necessary to downwards move the upper LED lamp into the working area of the reflector cup, the driving rotating ring may be clockwise or counter clockwise rotated by 90 degrees, then two short axes of the elliptical inner hole of the driving rotating ring are located above and below the substrate 5 respectively, the magnet 422 is located at the small-diameter end of the elliptical driving rotating ring (i.e. the short-axis end of the elliptical inner hole), and the distance between the two magnets 422 is shortened, so that the repulsive force between the two magnets is increased, and the support block 1 is driven by the magnetic force to downwards move to locate the upper LED lamp in the working area of the reflector cup to implement a switching process of turning on the LED lamps at different positions.

In an alternative embodiment not shown in FIG. 5, a direction of current may also be changed to change magnetic poles of the magnets to make the same the magnetic poles of the two magnets and drive the support block 1 to downwards move under the action of the repulsive force.

The other structures in the second embodiment are the same as those in the first embodiment, and will not be elaborated herein.

Third Embodiment

Figure 6:
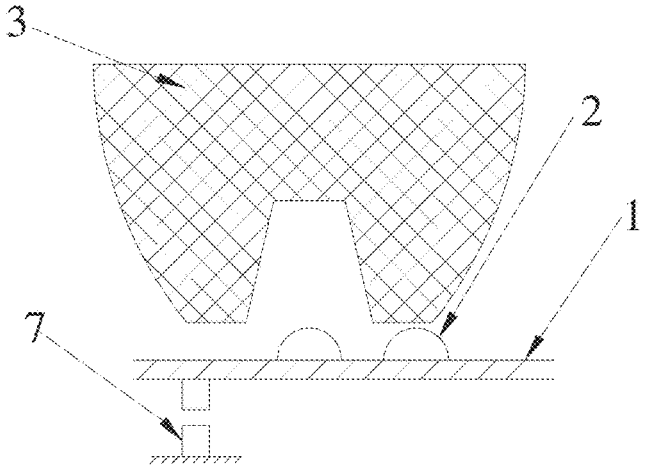
FIG. 6 is a section view of a third embodiment of an illumination device in another direction according to the invention.

FIG. 6 is a third embodiment of an illumination device according to the invention, and as shown in FIG. 6, a difference from the first embodiment is that: the light guiding part 3 in the third embodiment is a lens.

The other structures in the third embodiment are the same as those in the first embodiment, and will not be elaborated herein.

Fourth Embodiment

Figure 7:
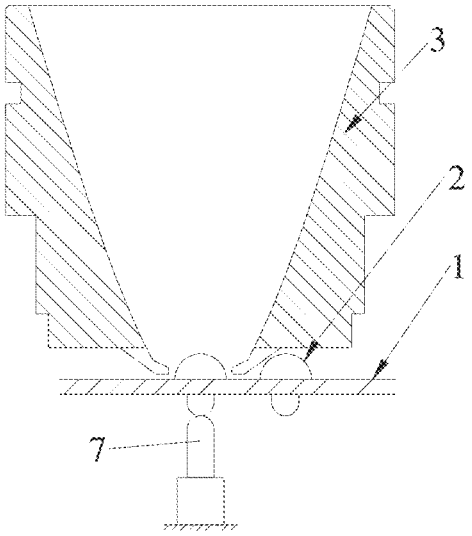
FIG. 7 is a local section view of a fourth embodiment of an illumination in another direction according to the invention.

FIG. 7 is a fourth embodiment of an illumination device according to the invention.

As shown in FIG. 7, in the fourth embodiment, the controller 7 controls the turning-on and turning off of the light source emitting parts 2 in a mechanical control manner. Specifically, the controller 7 is a thimble switch. The thimble switch is in contact conduction (i.e. electric connection) with the LED lamp located in the working area of the reflector cup, and namely may control the LED lamp to be in an on state, and at this time, the thimble switch does not contact with the LED lamp located outside the working area of the reflector cup, so that the LED lamp located outside the working area of the reflector cup is in an off state.

The other structures in the fourth embodiment are the same as those in the first embodiment, and will not be elaborated herein.

Alternative Embodiment

Figure 8:
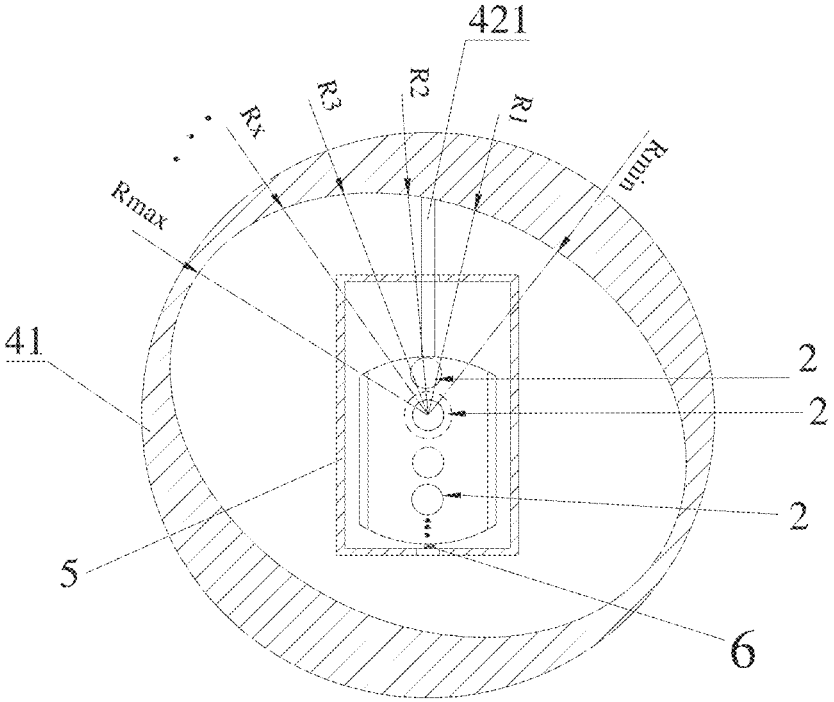
FIG. 8 is a section view of an alternative embodiment of an illumination device according to the invention.

As shown in FIG. 8, in a first alternative embodiment of the invention, a difference from the abovementioned embodiments is that: the number of the light source emitting parts 2 is not limited to be 2, and may be 3, 4 and the like. Only a maximum radius Rmax and minimum radius Rmin of a curve (ellipse) in the driving part 41 are used, and there are actually numerous different radiuses R1, R2, R3 and the like between the maximum radius Rmax and the minimum radius Rmin. When the driving part 41 rotates different angles, different radiuses may appear. On such a basis, multiple LED lamps serving as light source emitting parts 2 may be provided on the support block 1 for multi-light source switching according to a requirement. A specific implementation method is the same as that for two light sources, and will not be elaborated herein.

In a second alternative embodiment not shown in the invention, a difference from a processing manner for controlling movement of the light source emitting parts 2 in the abovementioned embodiments is that: in the second alternative embodiment, the reflector cup serving as the light guiding part 3 is driven by external force, and the reflector cup is controlled to move leftwards and rightwards (or move upwards and downwards) to be selectively matched with one of the multiple light source emitting parts 2, and since the light guiding part is shared by the multiple light source emitting parts, the illumination device is smaller in size and convenient to carry.

From the above description, it can be seen that the embodiments of the invention achieve technical effects as follows: the illumination device comprises the reflector cup with the paraboloid, the two LED lamps and the light source switching mechanism, and the reflector cup with the paraboloid may be driven by the light source switching mechanism to be selectively matched with one of the two LED lamps according to a requirement; and since the reflector cup with the paraboloid is shared by the two LED lamps, the illumination device is smaller in size and convenient to carry.

The above is only the preferred embodiment of the invention and not intended to limit the invention, and for those skilled in the art, the invention may have various modifications and variations. Any modifications, equivalent replacements, improvements and the like made within a spirit and principle of the invention shall fall within the scope of protection of the invention.

The invention claimed is:

1. An illumination device, comprising:

a support block;

multiple light emitting parts, provided on the support block;

a substrate, wherein the support block is located in the substrate;

a light guiding part for guiding light emitted by the light emitting parts to a preset irradiation direction; and a light source switching mechanism, the light guiding part adapted for being selectively matched with one of the multiple light emitting parts under the action of the light source switching mechanism;

wherein the light source switching mechanism comprises a driving part capable of rotating relative to the substrate and a transmission structure, the transmission structure provided in the driving part and adapted to convert rotation of the driving part into linear movement of the support block relative to the substrate, and the driving part provided with a driving surface, wherein a distance between the driving surface and a rotating centre of the driving part is variable.

2. The illumination device according to claim 1, wherein the driving part is provided on a periphery of the substrate in a sleeving manner.

3. The illumination device according to claim 1, wherein the transmission structure is an ejector rod, the substrate is provided with a first through hole through which the ejector rod extends, a first end of the ejector rod is connected with the support block, and a second end of the ejector rod is provided slidably along the driving surface.

4. The illumination device according to claim 1, wherein the transmission structure comprises two magnets which are in spaced-apart relationship, wherein a distance between the two magnets changes with rotation of the driving part.

5. The illumination device according to claim 4, wherein one of the two magnets is connected with the support block, and the other of the two magnets is provided slidably along the driving surface of the driving part.

6. The illumination device according to claim 2, further comprising a resetting element provided in the substrate, wherein the resetting element and the transmission structure are correspondingly provided at two ends, which are provided with interval, of the support block respectively.

7. The illumination device according to claim 6, wherein the resetting element is a spring, one end of the spring is connected with the support block, and the other end of the spring is connected with the substrate.

8. The illumination device according to claim 1, wherein the multiple light emitting parts are linearly provided or provided with intervals along a circumferential direction of the support block.

9. The illumination device according to claim 1, wherein the light guiding part is a lens or a reflector cup with a paraboloid.

10. The illumination device according to claim 1, further comprising a controller for controlling turning-on and turning-off of the light emitting parts.

11. The illumination device according to claim 10, wherein the controller is a thimble switch or a Hall switch.

12. The illumination device according to claim 1, wherein the driving part is adapted for rotation about an axis, and the transmission structure converts rotation of the driving part into linear movement of the support block in a radial direction relative to the axis.

13. The illumination device according to claim 1, wherein the driving part comprises a rotating ring and the driving surface comprises an inner wall surface of the rotating ring, wherein a cross section of the inner wall surface is an ellipse.

14. The illumination device according to claim 13, wherein the driving part is adapted for rotation about an axis, and the transmission structure converts rotation of the driving part into linear movement of the support block in a radial direction relative to the axis.

15. The illumination device according to claim 13, wherein the transmission structure slidably engages the inner wall surface of the rotating ring such that rotation of the rotating ring impart linear movement to the transmission structure.

16. The illumination device according to claim 13, wherein the transmission structure comprises an ejector rod adapted for driving the support block for moving the light emitting parts relative to the light guiding part.

17. The illumination device according to claim 1, wherein the support block is movable from an initial position to a second position for selectively matching one of the light emitting parts with the light guiding part, and further comprising a resetting element adapted for returning the support block to the initial position.

* * * * *